US008118168B2

(12) United States Patent
Holloway et al.

(10) Patent No.: US 8,118,168 B2
(45) Date of Patent: Feb. 21, 2012

(54) PORTABLE CABINET AND STORAGE CADDY FOR HOLIDAY, HOBBIES AND CRAFTS

(76) Inventors: Thomasena J. Holloway, Fort Mill, SC (US); Albert Holloway, Jr., Tampa, FL (US)

( * ) Notice: Subject to any disclaimer, the term of this patent is extended or adjusted under 35 U.S.C. 154(b) by 702 days.

(21) Appl. No.: 11/716,487

(22) Filed: Mar. 8, 2007

(65) Prior Publication Data

US 2007/0215513 A1 Sep. 20, 2007

(51) Int. Cl.
*B65D 69/00* (2006.01)
*B65D 85/42* (2006.01)
*A45C 13/00* (2006.01)

(52) U.S. Cl. ..... 206/575; 206/419; 206/565; 206/499; 220/23.88; 190/24; 190/35; 190/18 A

(58) Field of Classification Search ..... 206/391, 206/394, 564, 575, 419, 499, 561, 546, 565, 206/576; 220/23.83, 23.87, 23.88, 532, 4.22, 220/4.23, 4.24; 190/35, 36, 18 A, 39, 115, 190/13 F, 13 H, 18, 109–111
See application file for complete search history.

(56) References Cited

U.S. PATENT DOCUMENTS 154,697 A * 9/1874 Massie ..... 190/20
216,229 A * 6/1879 Sherriff ..... 190/36
475,950 A * 5/1892 Sparrow ..... 190/36
524,163 A * 8/1894 Coleman ..... 217/64
744,664 A * 11/1903 Worth ..... 190/35
1,240,144 A * 9/1917 Hoshino ..... 206/543
1,373,766 A * 4/1921 Sather ..... 15/38
2,321,794 A * 6/1943 Braun ..... 312/9.48
2,439,660 A * 4/1948 Keil ..... 280/37
2,499,623 A * 3/1950 Barnett ..... 312/9.9
2,798,784 A * 7/1957 Marshall ..... 312/199
2,843,304 A * 7/1958 Reifers ..... 206/521.1
2,885,136 A * 5/1959 Grant ..... 206/521.1
2,903,127 A * 9/1959 Dorman ..... 206/338
3,139,179 A * 6/1964 Cadotte ..... 206/549
3,447,714 A * 6/1969 Elliot ..... 206/1.5
3,452,879 A * 7/1969 Guarino ..... 211/71.01
3,516,596 A * 6/1970 Madden et al. ..... 206/521.1
3,887,068 A * 6/1975 Ghione ..... 206/223
3,939,982 A * 2/1976 Russell ..... 206/509
4,060,156 A * 11/1977 Gast ..... 190/30
4,118,048 A * 10/1978 Spranger et al. ..... 280/47.35
4,717,024 A * 1/1988 Djezovic ..... 206/581
4,911,295 A * 3/1990 Venegoni ..... 206/372
5,033,619 A * 7/1991 Garis ..... 206/419
5,255,816 A * 10/1993 Trepp ..... 220/529
5,409,126 A * 4/1995 DeMars ..... 220/4.27
5,417,344 A * 5/1995 Wells et al. ..... 220/571
5,454,478 A * 10/1995 Everson ..... 220/23.83
5,547,098 A * 8/1996 Jordan ..... 220/23.86

(Continued)

*Primary Examiner* — J. Gregory Pickett
*Assistant Examiner* — Ernesto Grano

(57) ABSTRACT

A combination rolling cabinet and storage assembly for storing and transporting collectibles therein, having: a top and bottom compartment; top and bottom walls joined by opposed side walls all joined to an upright rear wall, the cabinet defining an interior compartment accessible through an open upright front side of the door between open and closed positions; a base cabinet including wheels and a retractable/extendible pulling handle for locomoting; at least one additional cabinet connectable on top of the base cabinet; upper storage apparatus connectable on top of the base cabinet; a plurality of removable tote tray drawers or containers, and light holder carried in trunklike housing between top compartment and bottom compartment; can be loaded or unloaded upright or laying on floor or flat surface; and components are made of any suitable materials, preferably plastic.

8 Claims, 11 Drawing Sheets

U.S. PATENT DOCUMENTS 5,571,408 A * 11/1996 Rising ..... 210/167.29
5,653,339 A * 8/1997 Dobson ..... 206/420
5,816,407 A * 10/1998 Daratony ..... 206/576
6,186,351 B1 * 2/2001 Coyle ..... 220/23.83
6,347,847 B1 * 2/2002 Tiramani et al. ..... 312/108
6,382,377 B2 * 5/2002 Godshaw ..... 190/110
D467,424 S * 12/2002 Hardigg et al. ..... D3/279
6,612,454 B1 * 9/2003 Lin ..... 220/23.88
6,817,623 B1 * 11/2004 Gerutto ..... 280/655.1
7,111,732 B1 * 9/2006 Houtler et al. ..... 206/499
2005/0145533 A1 * 7/2005 Seligson ..... 206/575
2006/0231672 A1 * 10/2006 Eastwood et al. ..... 242/588.2

* cited by examiner 1
17
18
19
16
14
12
13
9
10
2
11
5
34
11
5
32

PORTABLE CABINET AND STORAGE CADDY FOR HOLIDAY, HOBBIES AND CRAFTS

BACKGROUND OF THE INVENTION

This invention relates generally to a portable cabinet equipped for rolling movement over a surface with an appendage housed inside, said device having separate, compartmentalized trays or containers for receiving, organizing, storing and transporting a plurality of collectible items for holiday such as ornaments, strands of lights, and related accessories, as well as for hobbies and crafts. As the popularity of holiday tree decorating grows dramatically, the need arose for a convenient and practical means to receive, organize, store and transport delicate collectibles.

In the past, delicate collectible items, lighting, and related accessories for the holiday have been stored in large plastic storage containers wherein the contents thereof cannot be secure from damage or breakage. There are no separate compartments or dividers to prevent contents from shifting, breaking or being destroyed.

The prior art is replete with reference to various types of organizers and portable storage devices. The prior art is not designed, intended, or adaptable for holiday, hobby, and crafting.

U.S. Pat. No. 4,444,418, to Goldstein, is directed to a carrying case for information and product samples. This case is particularly adapted for artwork or other similar, substantially flat material.

U.S. Pat. No. 3,913,711, to Schmid, relates to a portable display case comprising a pair of containers detachably connected to each other. Each container has a hingably connected cover portion that may be laid flat to support the compartment in a vertical position allowing display of goods contained therein.

None of these prior art patents relate to a portable cabinet and organizer with separate, compartmentalized trays or containers adaptable for receiving, organizing, storing and transporting a plurality of delicate collectibles.

The present invention meets these special objectives by a unique design and assembly. The manner by which such objectives are achieved will become apparent upon reading the following Specification, particularly when read in conjunction with the accompanying drawings.

BRIEF SUMMARY OF THE INVENTION

The invention relates to a portable cabinet with an appendage housed inside, said device having plurality of separate, compartmentalized tote tray or container for receiving, organizing, storing and transporting a plurality of collectible items for holiday and related accessories such as ornaments, one or more strand of lights, hobbies and crafts.

It is another object of this invention to provide a versatile, portable, efficient system to transport and adequately hold collectibles securely in a cabinet and within its inner compartment. This device housed inside the cabinet has separate, compartmentalized trays/containers with dividers that prevent items from shifting, bumping other items.

It is also an object of this invention to provide a storage and transportation cabinet with a plurality of trays that are reliable, convenient, and efficient in use, yet relatively inexpensive in construction.

It is a further object of this invention to provide a rigid storage and transporting device to store various collectible items and prevent its contents from shifting and becoming damaged or destroyed.

It is still another object of the present invention to provide an organizer which can be conveniently fit into an outer container of varying size and shape and which can also be partitioned into inner compartments.

It is a yet further object of this invention to provide a secure and reliable method of keeping strands of holiday lights from becoming twisted, tangled, damaged and broken.

Further objects of the present invention will be apparent from the description herein.

DETAILED DESCRIPTION OF THE INVENTION

The present invention relates generally to a portable cabinet equipped for rolling movement over a surface with an appendage housed inside, said device having separate, compartmentalized trays or containers for receiving, organizing, storing and transporting a plurality of collectible items such as ornaments and strands of lights and hobbies and/or crafts. The components of this invention are made of any suitable materials, preferably molded plastic.

Thus it is apparent that in accordance with the present invention, an apparatus that fully satisfies the objectives, aims and advantages is set forth above. While the invention has been described in conjunction with specific embodiments, it is evident that many alternatives, modifications, permutations and variations will become apparent to those skilled in the art in light of the foregoing description. Accordingly, it is intended that the present invention embrace all such alternatives, modifications, and variations as fall within the scope of the appended claims.

Figure 1:
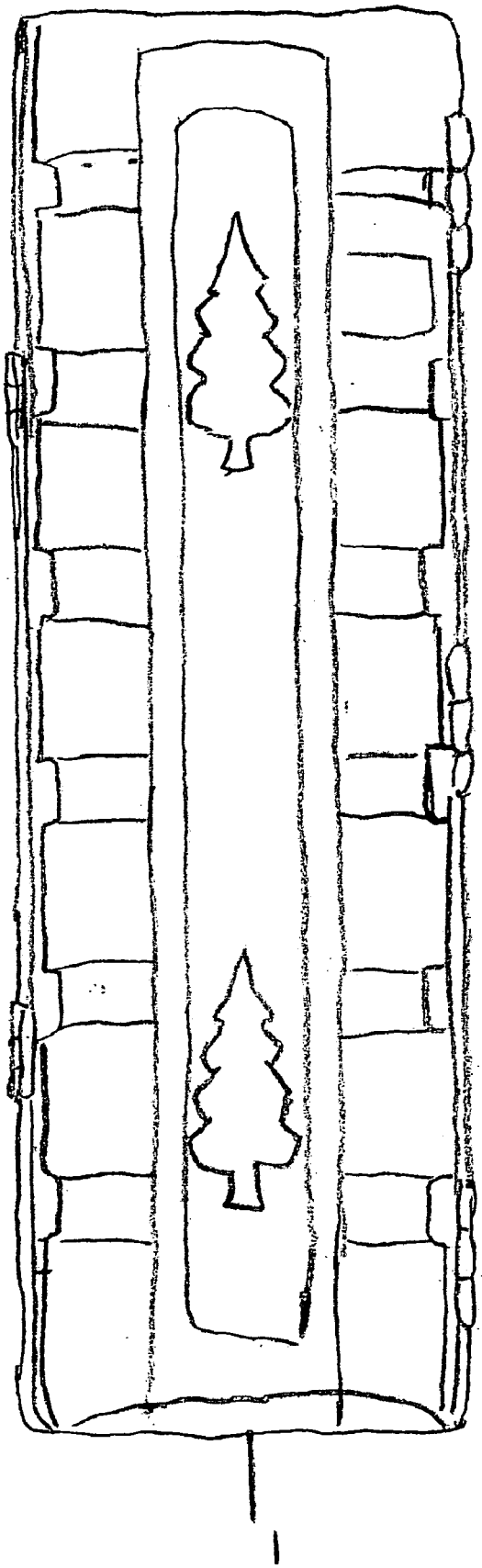
FIG. 1 is a perspective view of the front closed cabinet according to this invention.
Figure 5:
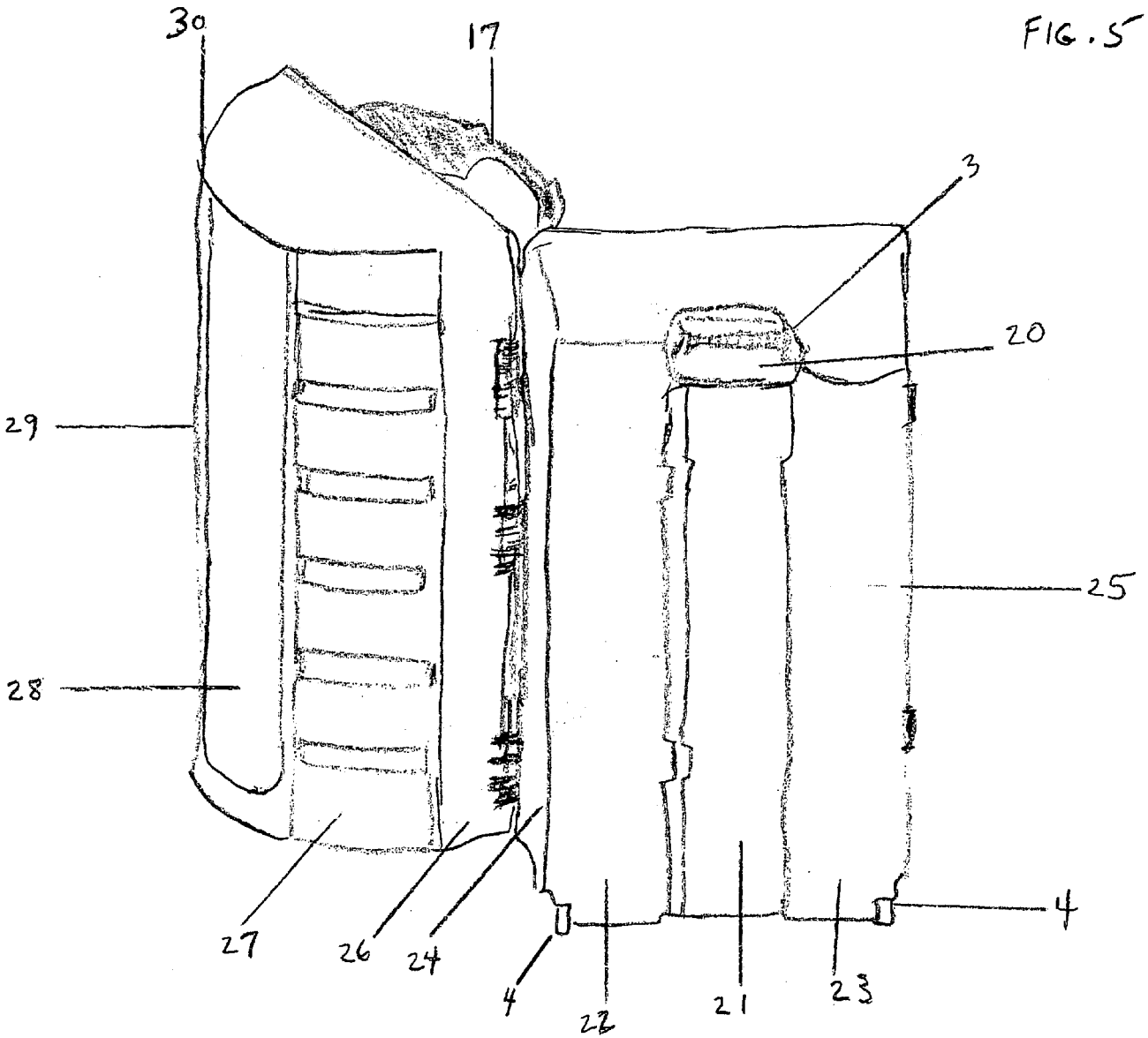
FIG. 5 is a back and side elevational view of an embodiment of the cabinet in an upright position illustrating the roller mechanism and handle displayed.
Figure 6:
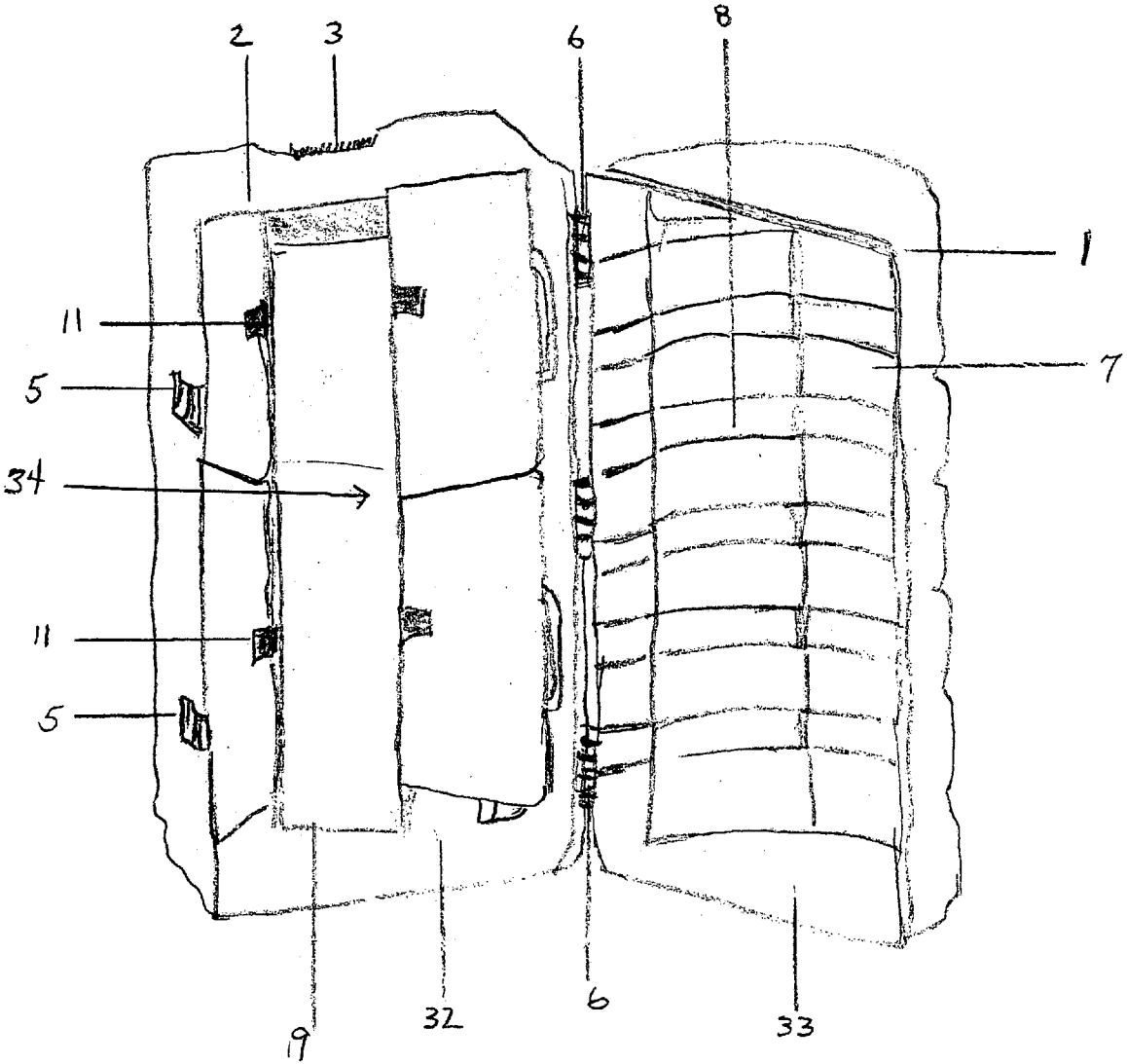
FIG. 6 is a perspective elevational view of the opened cabinet and storage caddy of the present intention illustrating latch and snap assembly with proper alignment of plurality of horizontal trays and empty chamber with plurality of shelves for rounded trays.
Figure 7:
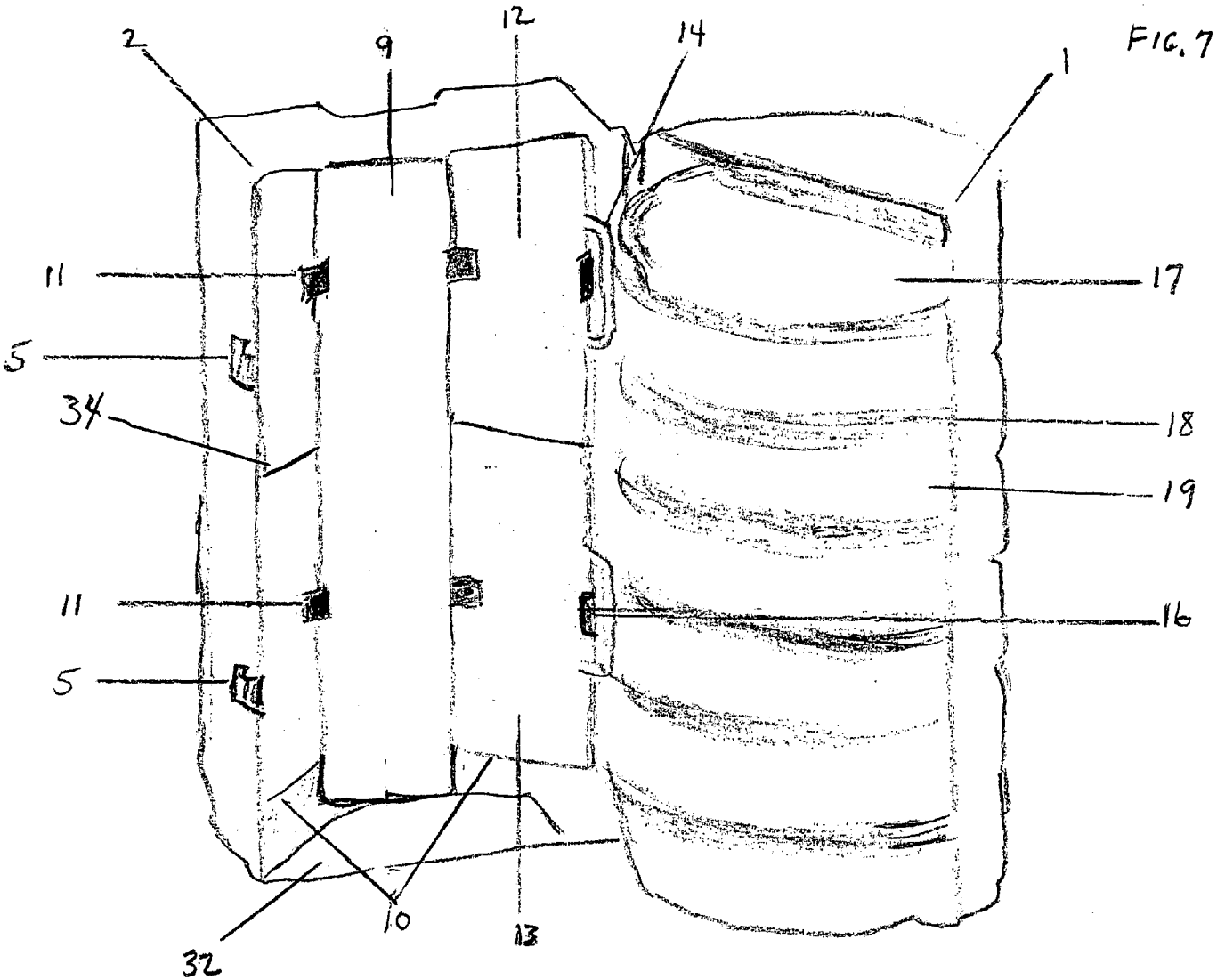
FIG. 7 is a second perspective view of the front and back portable cabinet of the present invention opened in upright position illustrating proper alignment of boxes for light strands and plurality of trays/containers nested together.
Figure 8:
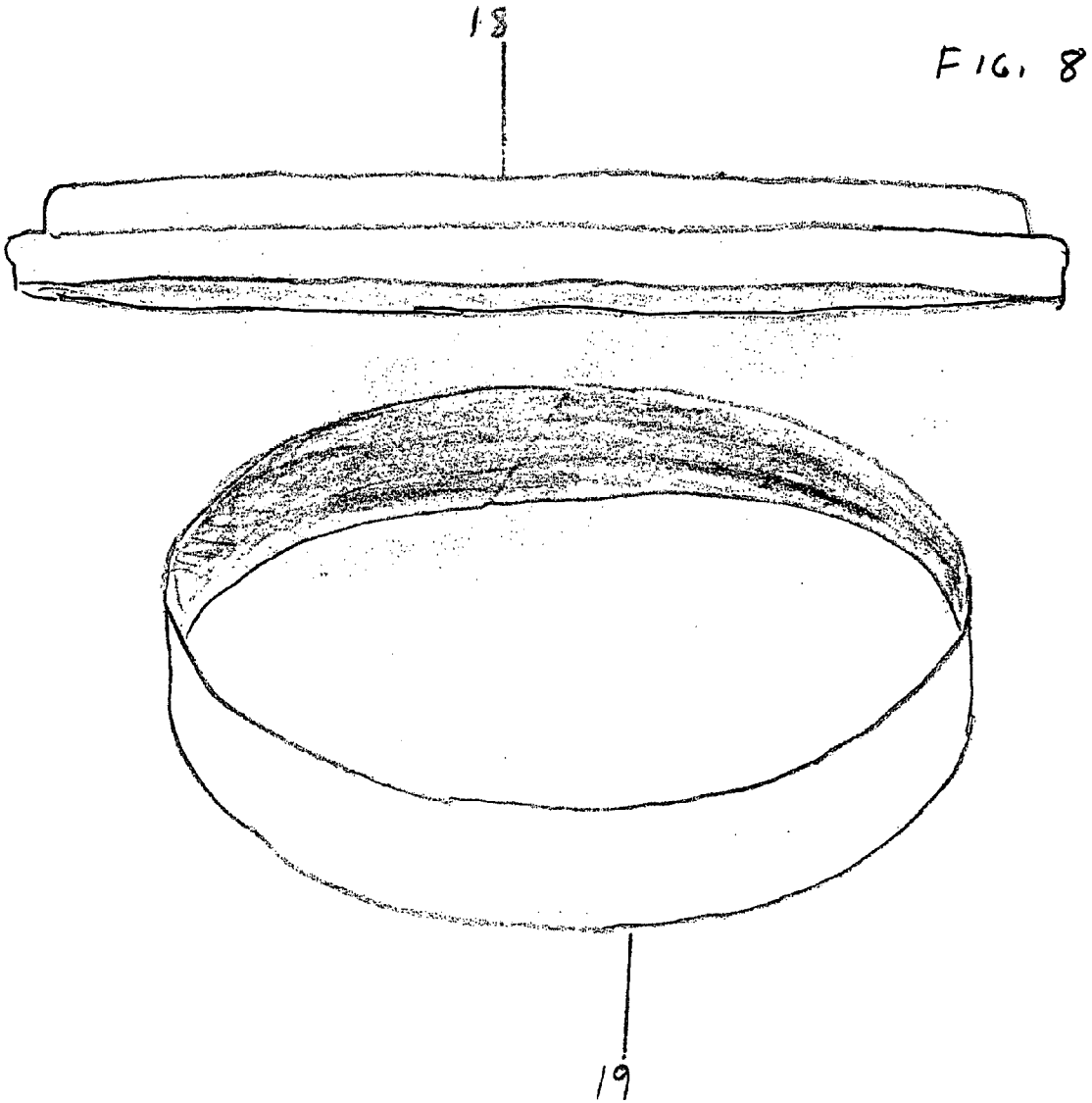
FIG. 8 is a perspective view of the lid and base components, forming the container.
Figure 9:
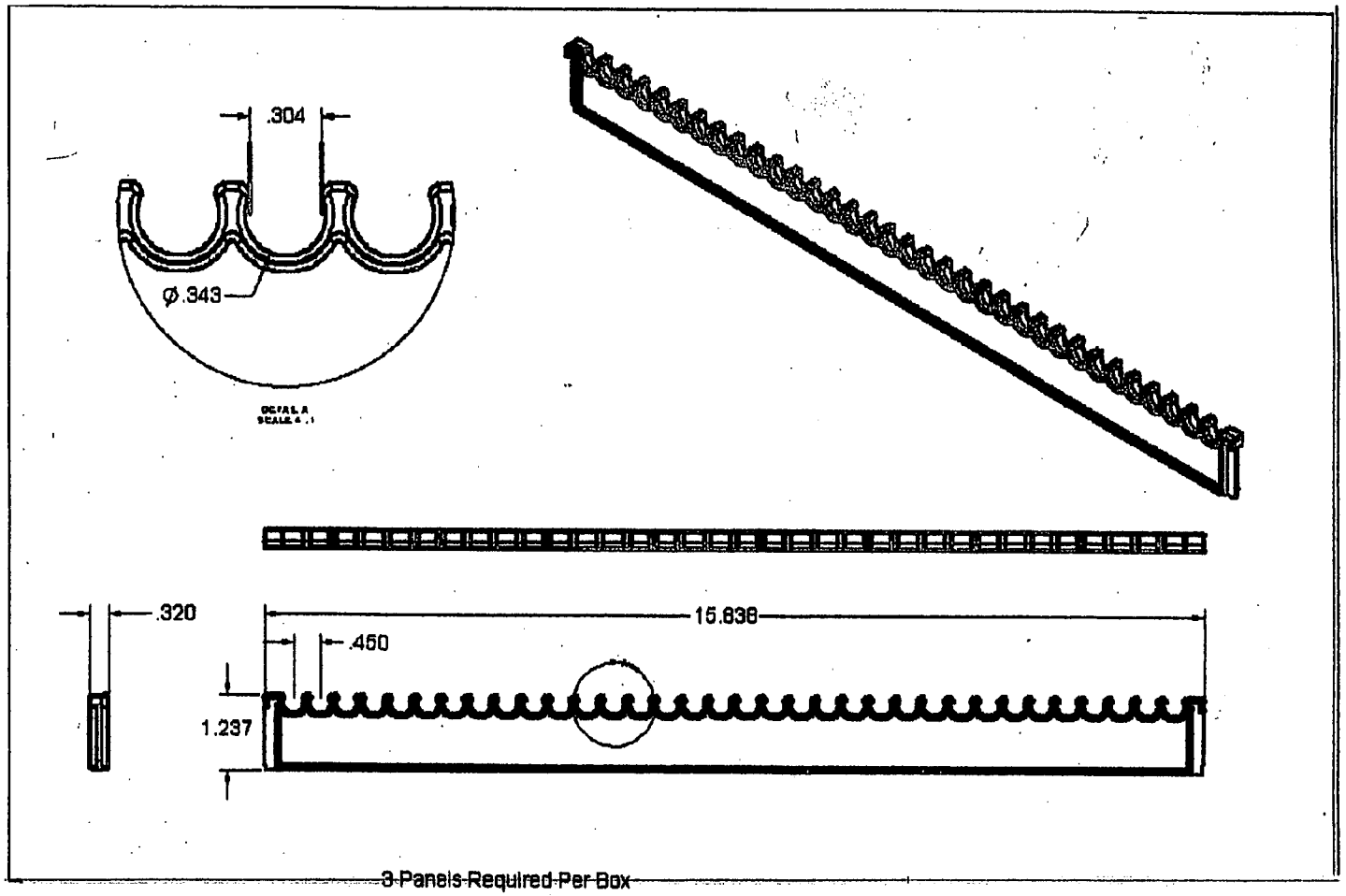
FIG. 9 is a schematic front view of the horizontal panel for securing light strands.
Figure 10:
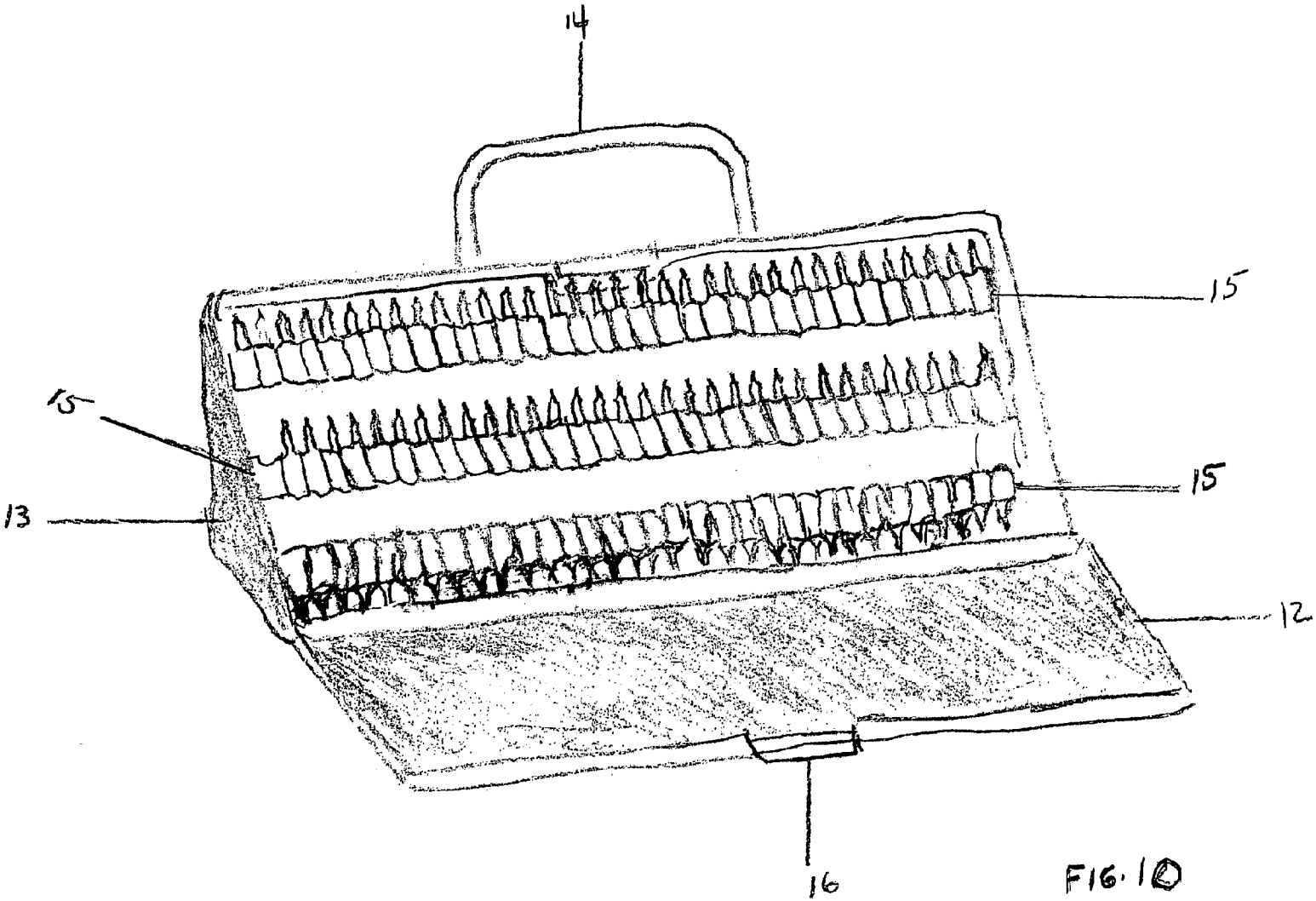
FIG. 10 is a perspective front and side view of rectangular box open illustrating proper alignment and placement of light strand and angled bottom.
Figure 11:
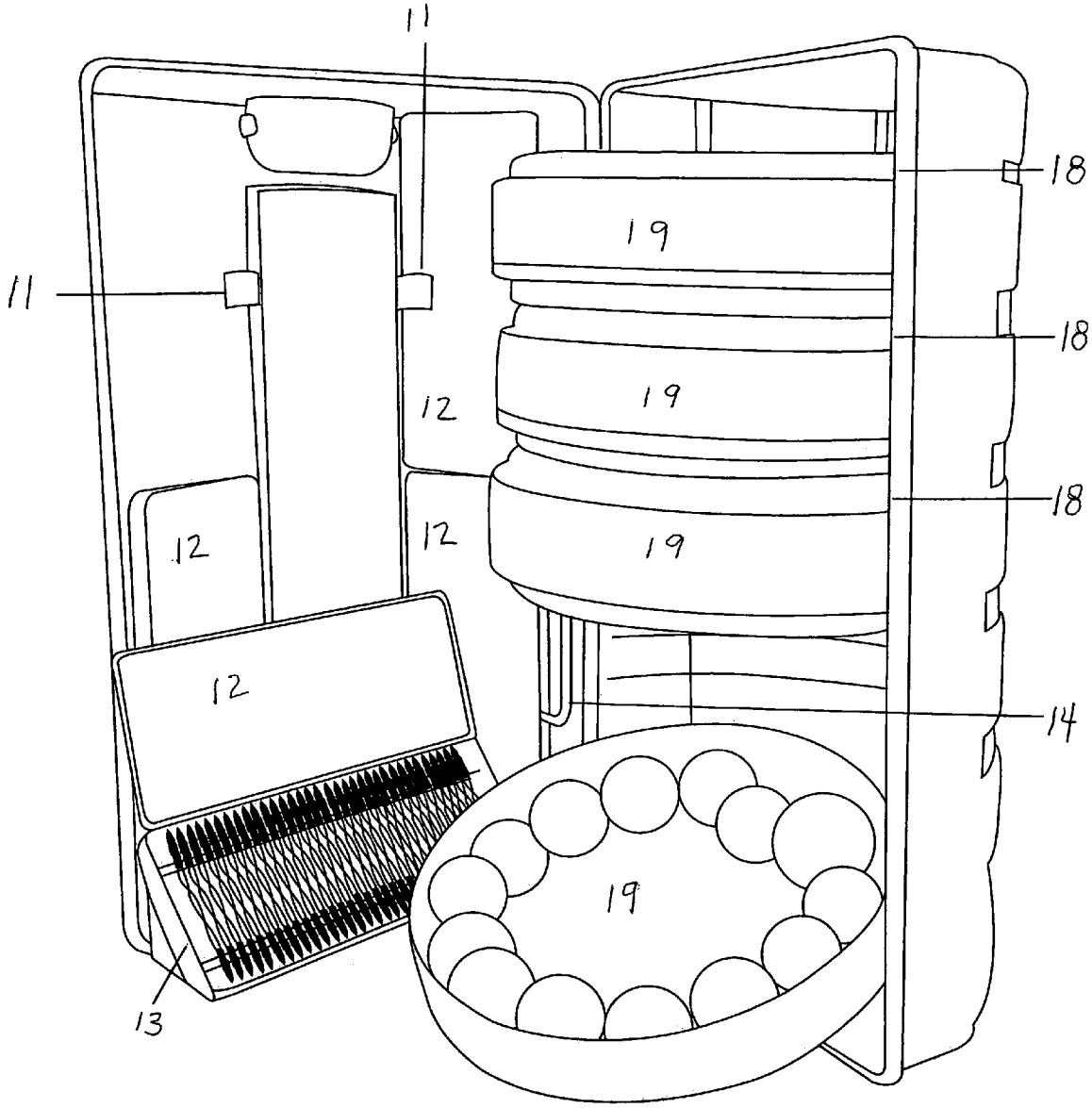
FIG. 11 is a schematic view of the portable cabinet and storage caddy of the present invention with the cabinet open and internal chambers, tote trays or containers displayed illustrating functionality and use.

Referring to the drawings and specifically FIGS. 1, 2, 3, 5, 6, 7, and 11, there is illustrated a portable cabinet and caddy organizer 7 and 11 according to the present invention. FIG. 1 illustrates the portable cabinet and caddy organizer in the closed transportable position, FIG. 6, illustrates the enclosure for the portable cabinet and caddy organizer in an open position, in a partially assembled state, and FIGS. 7 and 11 illustrates the portable cabinet and caddy organizer assembled. It will be appreciated that the assembled portable cabinet and organizer shown by FIGS. 6 and 7 are devoid of items such as ornaments, lights, collectibles, or the like, as well as such additional elements being deleted from the drawing for clarity of illustration.

FIG. 5 refers to rollers 4, which engage the rigid body portion for support, are mounted about adjacent to the bottom of portion of wall member 22 and 23. The rollers 4 are preferably position at the junction of rear panel 22 and the bottom of wall member 23. The rollers 4 are positioned to at least partially support the weight of the cabinet 14 when in the upright, or at rest position. The rollers 4 are operable to enable rolling movement of the cabinet across a surface when in an inclined position. The rollers 4 are preferably, molded plastic but may be any caster of a type known to those skilled in the art and may be mounted with an axle, snap or any other suitable material known to those skilled in the art.

The push/pull handle or gripping bar as shown in FIG. 5 is preferably a rigid handle, having two legs and a gripping member 3. The handle, which may also be stationary, is mounted on the cabinet 5 about adjacent to the rigid body portion at the top portion of wall member 20. The handle 3, which preferably, also includes a locking mechanism (not shown) for locking the handle in the retracted position, may be employed by the user to effect rolling movement of the cabinet 5 across the surface.

Figure 2:
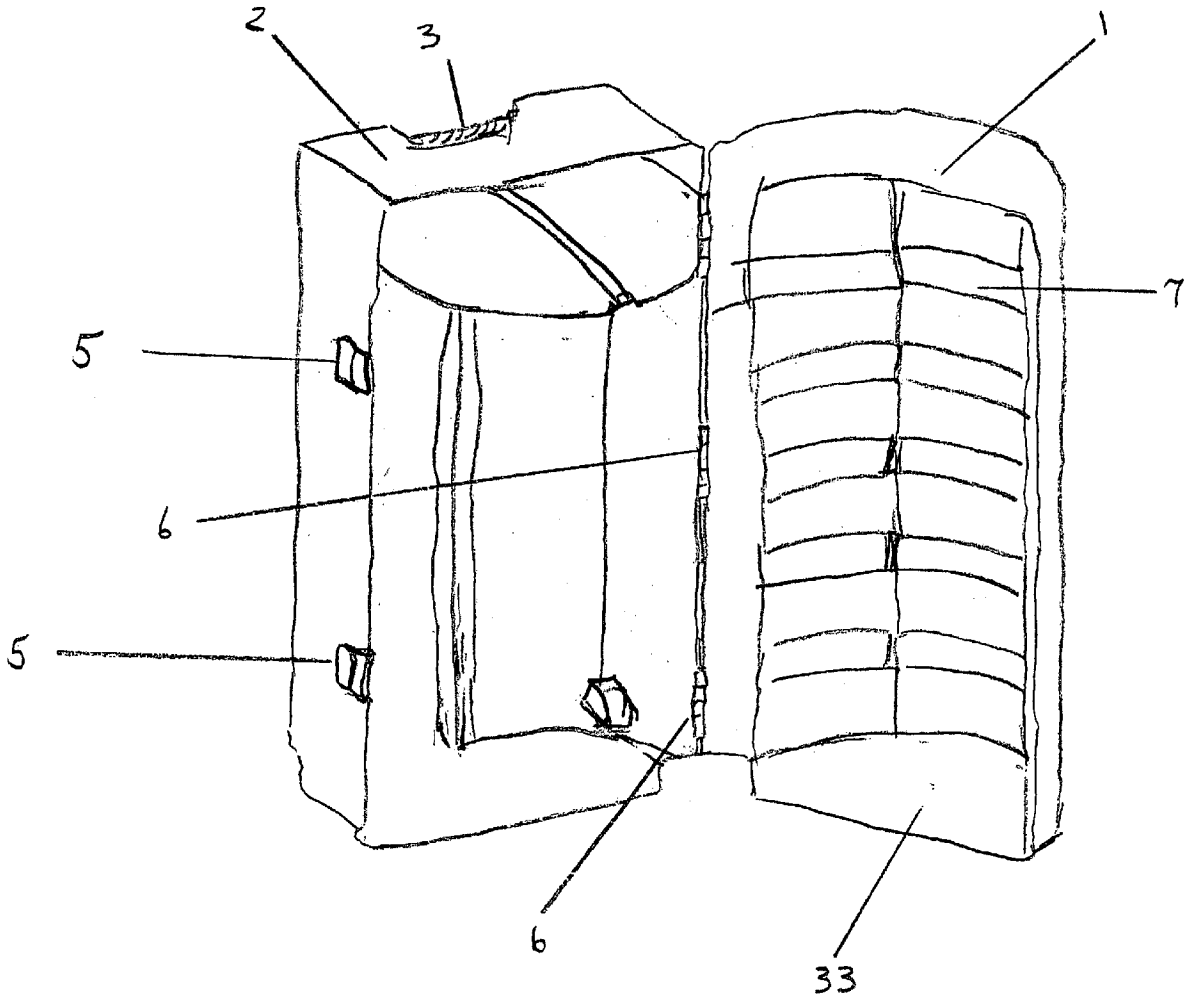
FIG. 2 is a perspective view of the front opened portable cabinet of the present invention.
Figure 3:
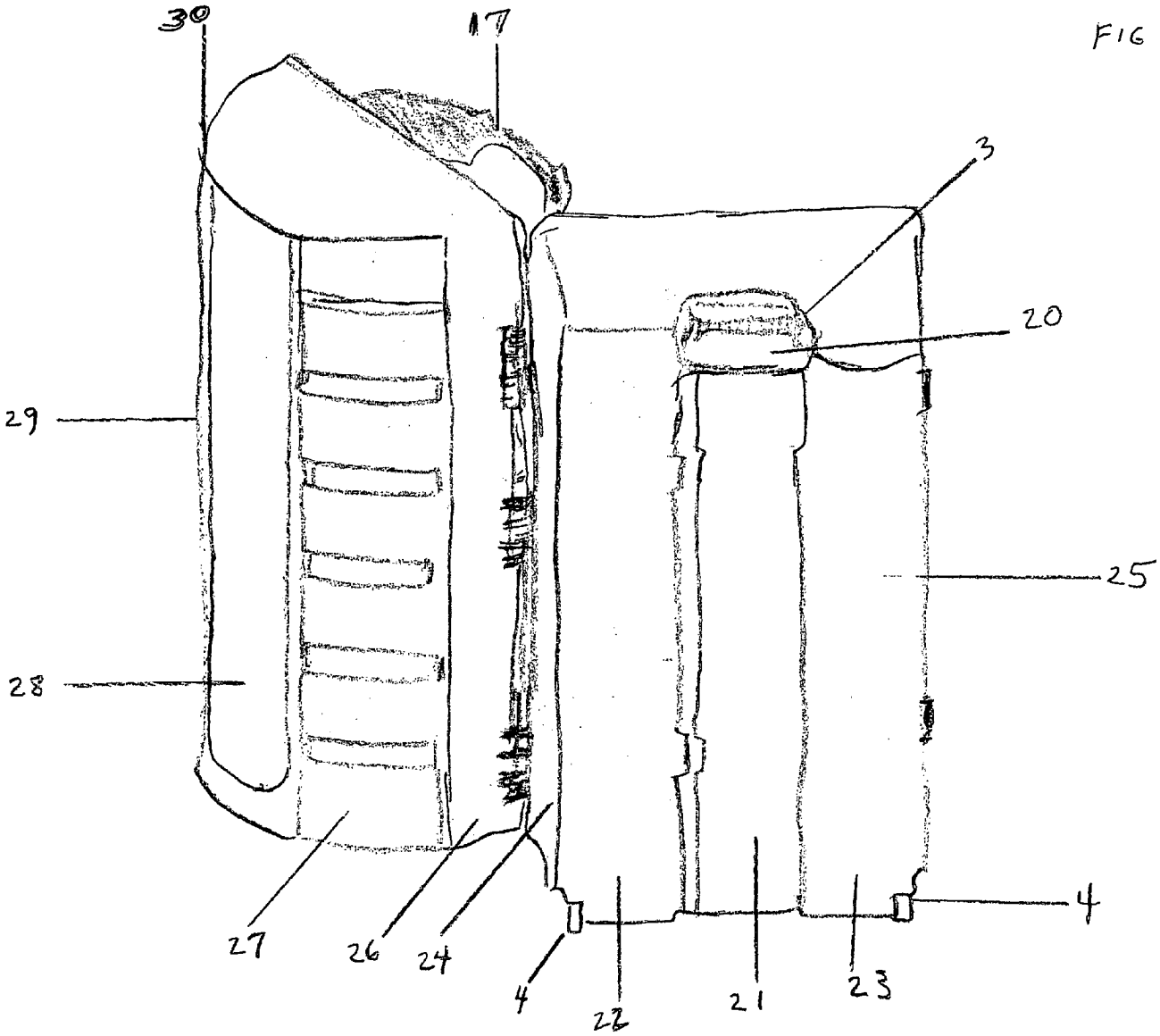
FIG. 3 is a perspective view of the back and side front view of the portable cabinet opened illustrating the hinged side cabinet of the present invention.

The portable cabinet and organizer as shown in FIG. 3, includes an enlarged six-sided trunklike enclosure or housing FIGS. 2 and 3 defined primarily by an upright cabinet FIG. 3 having an openable door 1 associated with one side thereof.

The upright cabinet as shown by FIGS. 2, 3 and 6, includes generally parallel and horizontally extending top and bottom walls 22 and 23 which are rigidly and permanently joined to generally parallel and vertically extending side walls 24 and 28. All of these walls 24, 25 26 and 28, in turn are rigidly joined to a generally vertically enlarged rear walls 22 and 23. Thus the formed cabinet has a front side 1 which is open so as to provide access to the rather large interior compartment FIGS. 2, 6, 7, and 11 defined by the cabinet.

The front side or opening 1 of the cabinet 3 is adapted to be closed by the door 1, the latter including a generally peripheral edge wall 22-30 defined between generally parallel and horizontally extending top and bottom edge walls 22-30, the latter being rigidly and permanent joined by parallel and vertically extending side edge walls 24 and 25. The peripheral edge wall is in turn joined to a vertically enlarged front wall or panel 26 which, in cooperation with the edge wall, causes the door 1 to define therein a compartment 8 which extends throughout substantially the full extent of the door but is of shallow horizontal depth. The bottom of this compartment 10 is defined by an inner flat panel which extends between the edge wall 24 and overlies the front panel 26. When the door 1 is closed onto the cabinet FIG. 3, the shallow door compartment 8 faces and is in open communication with the front side of the larger and deeper cabinet compartment 8.

The door 1 is connected to the cabinet 2 by a vertically elongated hinge 6 which defines a vertically extending hinge axis disposed adjacent the front edge of the side wall 24 and 26, whereby the door 1 can be horizontally hingedly swung between the closed and open positions illustrated respectively by FIGS. 3, 6 and 7.

Figure 4:
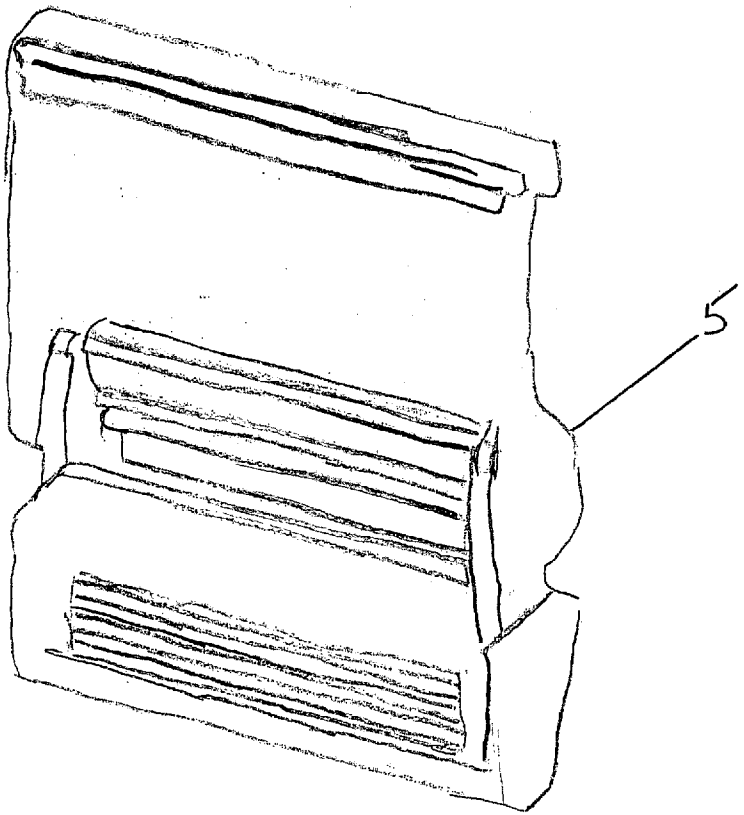
FIG. 4 is a perspective view of the opened latch assembly of the portable cabinet and storage cabinet of the present invention.

The side edge of the door remote from the hinge preferably has a conventional latch 5 FIGS. 4, 6 and 7 which cooperates with the cabinet when in the closed position so as to hold the door closed, such latch being typically activated in a conventional manner.

As shown by FIG. 6, the cabinet interior compartment 8 and 10 is preferably provided with appropriate organizer supports or elements positioned within the compartment 8 and 10 so as to cooperatively function as part of a portable cabinet and organizer. For example, in the illustrated embodiment the cabinet FIG. 6 stationarily mounts therein a first horizontal shelf 7 disposed so as to extend horizontally across the compartment adjacent the upper portion thereof but in slightly downwardly spaced relation from the top wall 1(*a*). A further stationary shelf 7(*b*) also extends horizontally across the cabinet compartment, this latter shelf 7(*f*) being positioned approximately midway between the top and bottom walls of the cabinet. The elevation of shelf 7 in a preferred embodiment is approximately at work surface or table height relative to the floor. A horizontally enlarged slidable shelf or tray 7(*b*) is also mounted on the cabinet at an elevation slightly below the shelf 7(*a*). This tray or shelf 7(*b*) is horizontally movably supported on conventional telescopic drawer slides 7(*b*) which mount to the underside of shelf 7(*a*), whereby tray 17 and 19 can be slidably moved between a storage position within the cabinet as illustrated in FIG. 7; and a use position illustrated in FIG. 11 wherein the container 19(*d*) projects outwardly from the front of the cabinet. When in the use position illustrated by FIG. 11, tray 19 can be readily used.

Cabinet shown in FIG. 6, also mounts therein various chambers and fixtures which cooperate to define a useable storage space when the portable cabinet and organizer is in the assembled position of FIG. 11. For example, in the illustrated embodiment the door 1 mounts thereon vertically, the latter being secured at the back of the shallow compartment 2 so as to extend across the inner surface of the front panel adjacent the upper end of the door.

Considering now the door 1 in the illustrated embodiment, also is provided with a drawer unit 12 and 13 which are disposed within the bottom compartment 8 directly above the bottom wall 33, and is again supported so that the drawer can be slidably moved inwardly and outwardly from the storage position into an access position illustrated by FIGS. 7 and 11 so as to access the upwardly opening compartment 8 thereof. If desired, a further tote tray drawer can be movably supported on the cabinet directly below the drawer being supported so as to be movable into an open position similar to the previous drawer as illustrated by FIGS. 6 and 11. The trays/containers permit storage of significant collectible items therein, both during utilization of the cabinet and organizer when the cabinet and organizer is in the position of FIG. 11 for storage.

The cabinet bottom 2 supports and stores therein an enlarged organizer, the latter being storable in an upright position within the shallow compartment 10 substantially as illustrated by FIGS. 6, 7 and 11. There is also provided a horizontally elongated top bracket/clasp 11 positioned within the shallow compartment of the door adjacent the upper end thereof. This bracket/clasp 11 extends horizontally across the door compartment, and has leverlike arms 11 at opposite ends thereof which joins the opposite side edge walls of the tray door to permit the bracket/clasp 11 to be vertically moved to accommodate removal of the tote tray about a horizontal hinge axis. This enables the bracket/clasp 11 to be moved slightly from a lowermost position as illustrated in FIG. 7 wherein it overlaps and engages the tote tray in the underside compartment 10, thereby trapping the storage tray and holding it securely in the bottom compartment, and in a lower storage position shown in FIGS. 6, 7 and 11, when the cabinet is resting on a flat surface and wherein the bracket/clasp is disposed directly adjacent the bottom edge wall 10.

The door 1 also mounts thereon, adjacent the lower free corner thereof (i.e., the lower corner remote from the hinge 6), a roller assembly 4 adapted to be disposed in stationary and load-bearing engagement with a support surface or floor when the door 1 is in the open position so as to not only maintain the door 1 stationary relative to the cabinet 7, but to also prevent load-bearing induced distortion of the door and cabinet which may otherwise interfere with proper utilization of the cabinet and organizer and specifically of the components associated therewith.

As indicated in FIG. 2, the bottom edge wall of the bottom 2 is disposed a small distance above the bottom wall 10 of the cabinet 3 and 5, thus providing sufficient space for accommodating the caster without unduly increasing the structural complexity of the lower edge of the door.

When the portable cabinet and organizer is in the open position as shown in FIGS. 2, 3 and 5, the cabinet 2 and door 1 function not only to support collectibles and equipment such as the shelves, drawers.

As shown by FIGS. 6, 7 and 11, the horizontal tote tray has one or more horizontally elongated device that is approximately 17 inches in length that fit in one bracket therein on opposing ends of the tray to organize and hold strands of lights in place and keep lights tangle-free.

As indicated in FIGS. 7 and 11 storage container has generally rounded components each with a top that aligns and mates in face-to-face relation with interlocking lips to hold items in the chamber. The containers are slidably mounted therein the storage cabinet from top to bottom. Components are of any suitable material, preferably molded plastic.

As illustrated in FIGS. 6, 7 and 11, one or more elongated, generally rectangular components are incorporated in the storage caddy chamber, each with a dedicated top and base and handle member, held in place by a pair of clasps 11 woven into the interior recessed sidewalls of the storage apparatus. The tote trays FIG. 11 slide in and out of the recessed storage chamber FIG. 7 for access and convenience in storage of collectibles.

While the portable cabinet and storage caddy organizer has been illustrated and described above incorporating various collectibles, equipment, and accessories (such as shelves, tote tray or container drawers, light comb, and the like) which are believed desirable to provide a portable cabinet and organizer having a minimal but comprehensive selection of usable features, nevertheless it will be appreciated that other structures or features can alternately or optionally be provided within the enclosure if desired.

The cabinet FIG. 12 will normally have a depth which is several times the average depth of the door compartment. Similarly, the enclosure 12 will normally have a height which is significantly greater than either the horizontal width or depth of the closed enclosure. In a typical construction, a cabinet will be a depth of about 17 inches, a width of about 17 inches, and a height of about 27 inches.

When transporting of the portable cabinet and storage caddy organizer as shown in FIGS. 7 and 11 of this invention is desired, then the portable cabinet and storage caddy organizer can be stored intact in an upright position with the door closed and latched so that the overall enclosure is in the closed position illustrated by FIG. 1 or tilt the cabinet and organizer rearwardly to permit the casters to rest on the a flat surface such as a floor or table.

Although a particular preferred embodiment of the invention has been disclosed in detail for illustrative purposes, it will be recognized that variations or modifications of the disclosed apparatus, including the rearrangement of parts, lie within the scope of the present invention.

LEGEND

1. Cabinet Top (Door) or Front
2. Cabinet Bottom or Back
3. Handle
4. Wheel Assembly
5. Cabinet Latch Assembly
6. Hinge Assembly
7. Shelf
8. Interior Top Chamber Compartment
9. Caddy Appendage
10. Interior Bottom Caddy Chamber Compartment
11. Clasp
12. Tote Tray Top
13. Tote Tray Bottom
14. Tote Tray Handle
15. Tote Tray Light Comb
16. Tote Tray Latch
17. Single Tray
18. Container Lid
19. Container Base
20. Handle Panel
21. Center Caddy Panel
22. Left Bottom Rear Wall
23. Right Bottom Rear Panel
24. Left Side Bottom Panel
25. Right Side Bottom Panel
26. Right Front Horizontal Panel
27. Right Front Caddy Panel
28. Center Front Horizontal Panel
29. Left Caddy Panel
30. Left Front Horizontal Panel
31. Cabinet Feet (not shown)
32. Bottom Floor Wall
33. Front Floor Wall
34. Horizontal Tray Shelf

We claim:

1. A portable storage cabinet with at least two tote trays and at least two storage containers to receive, organize, store, and transport a plurality of collectable holiday items, hobby accessories, and crafts, said storage cabinet comprising:

a cabinet defined by a front door member and back member, wherein said front door member forms a front door member compartment and said back member forms a back member compartment, each generally shaped like a barrel and positioned opposite one another when in a closed position, said front door member is hingedly attached to said back member, said front door member and said back member each having a rigid body portion to provide support therefore;

rollers mounted to a bottom portion of a back panel of said back member and positioned to at least partially support said portable storage cabinet when said portable storage cabinet is in a generally upright position and to enable a rolling movement of said portable storage cabinet across a surface when said portable storage cabinet is in an inclined position;

said front door member compartment includes a plurality of shelves configured to nest said at least two storage containers;

a latch assembly positioned on a side wall of said back member, said latch assembly is adapted to securely attach to a side wall of said front door member to close said portable storage cabinet;

said back member compartment includes two elongated tote tray receiving regions wherein said at least two tote trays are removably attached, each of the at least two tote trays is a generally triangular box which includes a tote tray top and a tote tray bottom, said tote tray top is hingedly connected to said tote tray bottom, said tote tray bottom includes a tote tray bottom compartment with a plurality of removable inner panel comb members that are adapted to securely fit respective ends of each light of at least one strand of holiday lights;

wherein said back panel of said back member includes a gripped bar handle for transporting said portable storage cabinet; and wherein when said portable storage cabinet is in said closed position, said at least two storage containers nested within said front door member compartment extend into said back member compartment and are positioned adjacent to said at least two tote trays within said back member compartment.

2. The portable storage cabinet according to claim 1, wherein said rollers are a pair of wheels which are capable of being mounted by an axle or snapped into place.

3. The portable storage cabinet according to claim 1, wherein said portable storage cabinet, at least two tote trays, and at least two storage containers are molded out of plastic.

4. The portable storage cabinet according to claim 1, wherein each of the said at least two containers comprise a rounded tray bottom and an interlocking rounded top for securing said accessories therein.

5. The portable storage cabinet according to claim 1, wherein said at least two tote trays are removably attached to the said back member compartment by at least two clasps.

6. The portable storage cabinet according to claim 1, wherein each of said at least two tote trays includes a snap for locking said tote tray top to said tote tray bottom.

7. The portable storage cabinet according to claim 1, wherein said plurality of removable inner panel comb members include teeth for securing said at least one strand of holiday lights.

8. The portable storage cabinet according to claim 1, wherein said gripped bar handle includes a locking mechanism for locking said gripped bar handle in a retracted position.

* * * * *